US009587386B2

(12) United States Patent
Wobbrock et al.

(10) Patent No.: US 9,587,386 B2
(45) Date of Patent: Mar. 7, 2017

(54) CONVEX-BOTTOM SINK WITH IMPROVED SELF-RINSING CAPABILITY

(71) Applicants: Nicholas Wobbrock, Berkeley, CA (US); Jan Pawluskiewicz, Seattle, WA (US)

(72) Inventors: Nicholas Wobbrock, Berkeley, CA (US); Jan Pawluskiewicz, Seattle, WA (US)

(73) Assignee: Cascade Revolution LLC, Portland, OR (US)

( * ) Notice: Subject to any disclaimer, the term of this patent is extended or adjusted under 35 U.S.C. 154(b) by 130 days.

(21) Appl. No.: 14/641,884

(22) Filed: Mar. 9, 2015

(65) Prior Publication Data

US 2016/0237664 A1 Aug. 18, 2016

Related U.S. Application Data

(63) Continuation-in-part of application No. 29/517,424, filed on Feb. 12, 2015, now Pat. No. Des. 753,277.

(51) Int. Cl.

| | |
|---|---|
| ***A47K 1/04*** | (2006.01) |
| ***E03C 1/182*** | (2006.01) |
| ***E03C 1/181*** | (2006.01) |

(52) U.S. Cl.

CPC ..... *E03C 1/182* (2013.01); *A47K 1/04* (2013.01); *E03C 1/181* (2013.01)

(58) Field of Classification Search

CPC ..... E03C 1/33
USPC ..... 4/619–660; D23/204; D28/61; 132/73; 601/17

See application file for complete search history.

(56) References Cited

U.S. PATENT DOCUMENTS

| | | | | | |
|---|---|---|---|---|---|
| 1,841,053 | A | * | 1/1932 | Porter | A47K 1/02 312/245 |
| 2,169,990 | A | * | 8/1939 | Preve | A45D 29/00 132/73 |
| D155,435 | S | * | 10/1949 | Mangold | A45D 29/00 132/73 |
| 2,580,981 | A | * | 1/1952 | Webster | A45D 29/00 132/73 |
| D167,672 | S | * | 9/1952 | Blackburn | A45D 29/00 D28/61 |
| 3,629,876 | A | * | 12/1971 | Wright | E03C 1/18 239/543 |
| 3,673,617 | A | * | 7/1972 | Schulz, Jr. | B29C 44/12 264/261 |
| 4,162,545 | A | * | 7/1979 | Hallen | A47K 1/04 4/650 |
| 4,441,487 | A | * | 4/1984 | Daugherty | A61H 23/0218 132/73 |
| D278,367 | S | * | 4/1985 | Sussman | A45D 29/00 D28/61 |
| 4,762,273 | A | * | 8/1988 | Gregory | E03C 1/057 137/801 |
| 5,810,021 | A | * | 9/1998 | Walker | A45D 29/007 132/74.5 |

(Continued)

*Primary Examiner* — Lori Baker
(74) *Attorney, Agent, or Firm* — Mersenne Law

(57) ABSTRACT

A sink basin having a convex hump in the floor of the basin improves self-rinsing by directing water falling into the basin from a faucet to flow clown the hump and across the floor of the basin, then around the perimeter of the basin to the drain orifice. A variety of shapes, materials and surface finishes are also described and claimed.

20 Claims, 3 Drawing Sheets

(56) References Cited

U.S. PATENT DOCUMENTS

| | | | | | |
|---|---|---|---|---|---|
| D440,712 | S | * | 4/2001 | Lu | A45D 29/00 D28/61 |
| D443,112 | S | * | 5/2001 | Lu | A45D 29/00 D28/56 |
| D587,406 | S | * | 2/2009 | Ruiz | A45D 29/00 D28/61 |
| D670,354 | S | * | 11/2012 | Tran | A45D 29/00 D23/204 |
| 2012/0151672 | A1 | * | 6/2012 | Bucher | A47K 1/04 4/650 |
| 2013/0152301 | A1 | * | 6/2013 | Brown | E03C 1/18 4/638 |
| 2013/0152302 | A1 | * | 6/2013 | Brown | E03C 1/18 4/638 |
| 2013/0152303 | A1 | * | 6/2013 | Brown | E03C 1/18 4/638 |
| 2015/0354188 | A1 | * | 12/2015 | Hocaoglu | E03C 1/18 4/633 |

* cited by examiner

Fig. 3
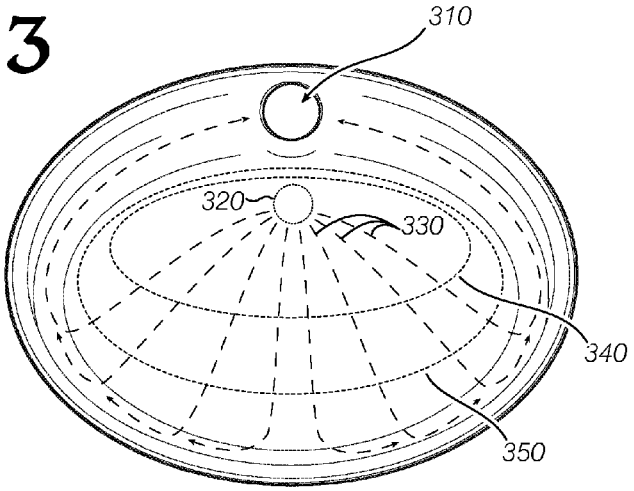
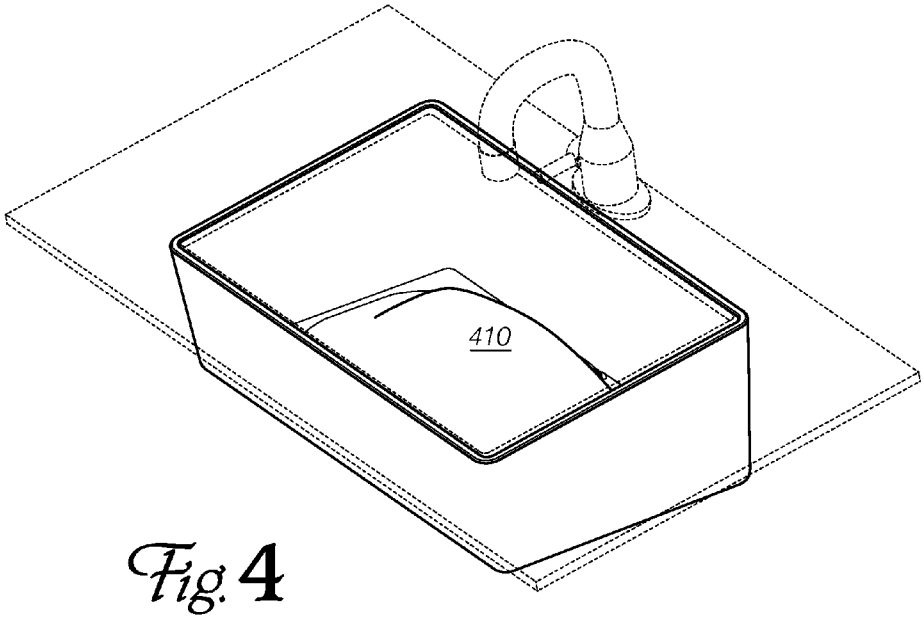
Fig. 4

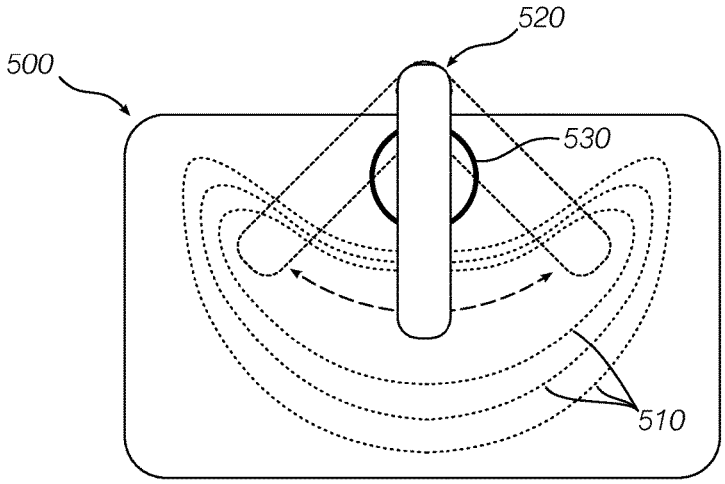
Fig. 5
Fig. 6
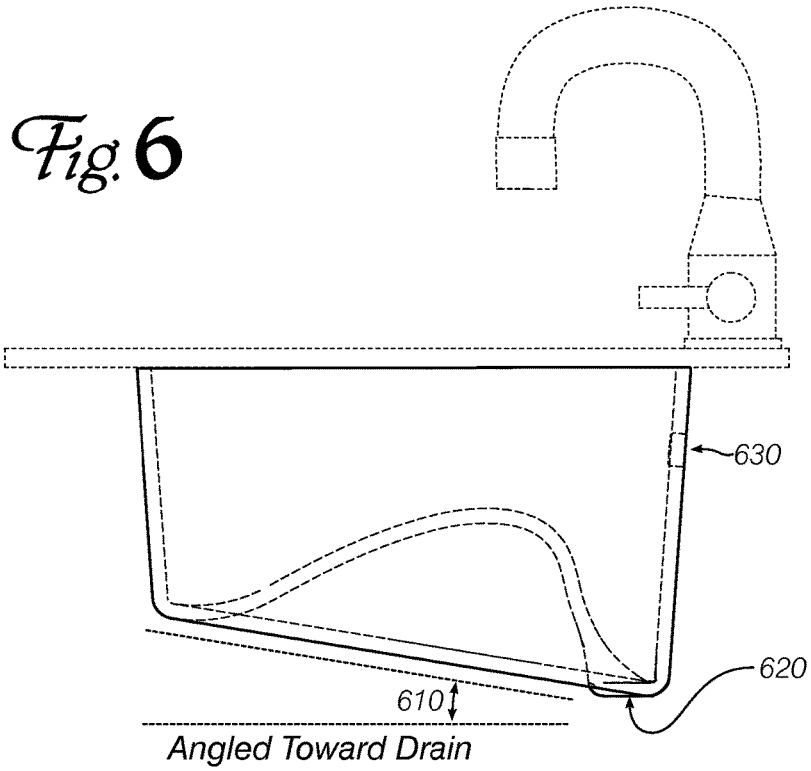

CONVEX-BOTTOM SINK WITH IMPROVED SELF-RINSING CAPABILITY

CONTINUITY AND CLAIM OF PRIORITY

This is an original U.S. patent application that claims priority to U.S. design patent application Ser. No. 29/517,424 filed 12 Feb. 2015.

FIELD

The invention relates to wash receptacles. More specifically, the invention relates to sink basins having a shape and configuration that promotes self rinsing and reduces debris and residue collection.

BACKGROUND

Sinks and wash basins are manufactured in a wide range of sizes, shapes and finishes, suitable for a similarly wide range of applications. Where practical considerations such as cost, durability and standardization outweigh aesthetics, sinks are commonly made of metal or glazed porcelain in an oval or rectangular bowl shape. These configurations are compatible with standard plumbing fixtures (faucets, drains, etc.) and can be installed (and replaced, when necessary) with common tools and construction techniques.

One challenge that arises in maintaining sinks and wash basins is keeping the inside surfaces clean between uses. Special coatings have been used in some applications, but generally, one must rinse (and perhaps wipe or scrub) debris from the basin periodically. This can represent a significant expense in many installations (e.g., hotels and large office facilities), yet failure to perform this simple maintenance may have an outsized effect on the overall perceived cleanliness of the rooms where the sinks are located.

Sink designs that stay cleaner longer may permit extended maintenance intervals, reduce cleaning costs and prevent at least some environmentally-harmful cleaning chemicals from entering the wastewater stream.

SUMMARY

Embodiments of the invention are sinks or wash basins having a novel bottom shape that promotes improved rinsing of the basin by water flowing directly from a faucet as well as water that has been used to clean or rinse an object being washed in the sink.

BRIEF DESCRIPTION OF DRAWINGS

FIG. 3 shows a plan view of the oval sink with typical water flow indicated.

FIG. 4 shows a rectangular sink according to an embodiment of the invention.

FIG. 5 shows how the convex hump in the bottom of a sink may be shaped to match the mouth of a pivoting faucet.

FIG. 6 shows how the outer perimeter of an embodiment is sloped, angled or slanted toward a drain located near the lowest point of the basin.

DETAILED DESCRIPTION

Embodiments of the invention are similar in size and shape to standard plumbing fixtures, but instead of a flat or concave bottom (with a drain orifice at the lowest point), the inventive sinks have a raised or convex bottom, which causes water striking the bottom to flow outward and down toward the perimeter of the sink, carrying with it debris that has fallen into the sink. Water thence flows around the bottom perimeter and to a suitably-located drain.

Figure 1:
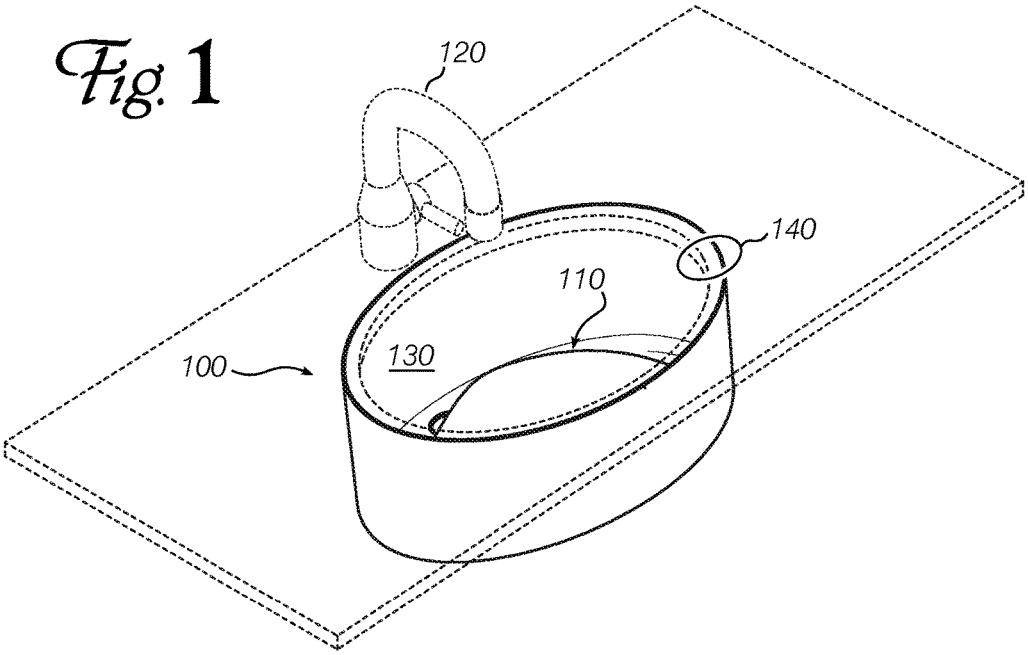
FIG. 1 shows an oval sink according to an embodiment of the invention.

FIG. 1 shows an exemplary embodiment of the invention: an oval hand-washing sink 100 having a raised "hump" 110 whose apex is preferably located near the center of a stream of water from a faucet 120. The wall of the outer perimeter of the sink 130 may be more vertically oriented than a comparable prior-art sink basin. The sink may have a lip 140 suitable for either drop-in (i.e., through the countertop) or undermount (affixed underneath the countertop) installation.

Figure 2:
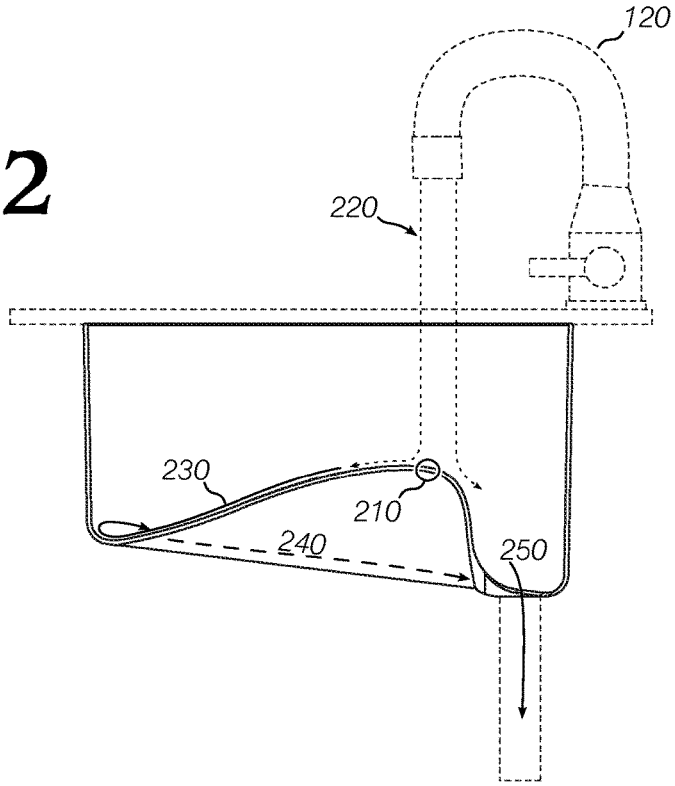
FIG. 2 shows a cutaway view of the oval sink.

FIG. 2 shows a cutaway view of the sink of FIG. 1, illustrating how the convex hump may be shaped and how the apex of the hump 210 lies under a stream of water 220 flowing from the faucet 120. Some of the water striking the hump flows backwards, 230, away from the drain, before reaching the outer perimeter of the sink and turning to flow around the bottom outside edge 240 to the drain 250.

FIG. 3 shows a top view of the same sink, with water flow directions indicated. In this embodiment, the drain 310 is located at the bottom, back portion of the sink (viewed from the user's perspective), near where the drain of a traditional sink is placed. Water from the faucet strikes the convex hump near clashed circle 320 before flowing clown the hump toward the outer perimeter of the sink basin as shown by long-clashed lines 330. (Contour lines of the hump are indicated as 340 and 350.) Once the water reaches the outer perimeter, it flows clown and around to the drain 310. Although the drain in this embodiment is near where a conventional drain might be placed, an embodiment of the invention may instead place the drain at the front of the basin, nearer the user, or at another location around the outer perimeter.

Although lavatory sinks are often round or oval in shape, embodiments of the invention can also be used in applications where square or rectangular shapes are more common. FIG. 4 shows such a sink; the raised or convex hump is indicated at 410.

In some applications, a moveable faucet may be provided. For example, in a kitchen sink, the faucet mouth is frequently moveable from left to right in an arc about a centrally-located pivot point. A sink basin according to an embodiment of the invention suited for this application, FIG. 5, generally 500, may have a curved or crescent-shaped hump as indicated by clashed contour lines 510, with a "ridgeline" (rather than a single "apex") placed so that it lies under the mouth of faucet 520 as the faucet is moved from side to side. The drain may be placed as shown at 530.

In an embodiment of the invention, the convex hump is placed so that water falling on it (either directly from the faucet or dripping from the object(s) being washed) tends to flow out toward the perimeter of the sink. The outside perimeter is itself angled toward the front, back or side of the sink where the drain is located. (See FIG. 6.) This tends to carry debris that falls onto the hump away from the center of the sink to the periphery, and from there toward the drain. Note that embodiments of the invention may also include conventional features, such as an overflow drain 630 to help prevent accidents if the normal drain is obstructed.

Embodiments may be constructed of any conventional material, such as formed stainless steel, enameled cast iron, cast polymer, milled stone, or glazed porcelain. However, it is preferred that the interior surface be coated or treated with a hydrophilic finish so that water tends to flow in sheets over it. This helps move debris out of the sink, and can prevent water spotting when the sink is allowed to air-dry.

The principles of the present invention have been described largely by reference to specific example embodiments. However, those of skill in the art will recognize that sink basins with improved self-cleaning or self-rinsing characteristics can also be formed in other shapes, while nevertheless practicing the inventive principles. Such variations are understood to be captured according to the following claims.

We claim:

1. A self-rinsing sink basin comprising:

a mounting lip;

substantially vertical walls extending downward from the mounting lip and forming an outer perimeter of a basin, said outer perimeter angled toward a lowest point along the outer perimeter;

a drain hole located near the lowest point; and a floor of the basin, the floor having a convex hump rising smoothly upward from the floor to an apex below the mounting lip, and the apex of the convex hump positioned to lie near a stream of water from a faucet installed near the basin, the basin and convex hump shaped to cause water falling on the convex hump to flow toward the outer perimeter of the basin and thence around the outer perimeter to the drain hole.

2. The self-rinsing sink basin of claim 1, further comprising:

an overflow drain hole formed in one of the substantially vertical walls.

3. The self-rinsing sink basin of claim 1 wherein the mounting lip is configured for drop-in mounting.

4. The self-rinsing sink basin of claim 1 wherein the mounting lip is configured for undermount fixation.

5. The self-rinsing sink basin of claim 1 having an interior surface finish that causes water flowing over the surface to sheet.

6. The self-rinsing sink basin of claim 1 wherein a plan-view shape of the basin is oval.

7. The self-rinsing sink basin of claim 1 wherein a plan-view shape of the basin is rectangular.

8. The self-rinsing sink basin of claim 1 wherein the convex hump is crescent-shaped, a ridgeline of said crescent shape roughly aligned with an arc of a mouth of a pivoting faucet.

9. A sink basin having self-rinsing characteristics, comprising:

a concave basin having roughly vertical side walls and a tilted outer perimeter near bottom extents of the side walls;

a drain hole near a lowest point of the concave basin; and a basin floor having a convex hump rising smoothly above a level of the bottom extents of the side walls to a high point below an upper extent of the side walls, said high point of said convex hump positioned to lie near a stream of water from a faucet installed near the concave basin.

10. The sink basin of claim 9, further comprising:

a mounting lip for securing the sink basin to a countertop.

11. The sink basin of claim 10 wherein the mounting lip is a drop-in mounting lip.

12. The sink basin of claim 10 wherein the mounting lip is an undermount mounting lip.

13. The sink basin of claim 9, formed from any of stainless steel, polymer or glazed porcelain.

14. The sink basin of claim 9, having a hydrophilic interior surface.

15. The sink basin of claim 9, further comprising:

an overflow drain hole through the roughly vertical side walls.

16. The sink basin of claim 15 wherein the overflow drain hole is above the high point of the convex hump.

17. The sink basin of claim 15 wherein the overflow drain hole is at a level of the high point of the convex hump.

18. The sink basin of claim 15 wherein the overflow drain hole is below the high point of the convex hump.

19. The self-rinsing sink basin of claim 1, wherein a first portion of the falling water flows clockwise around the outer perimeter to the drain hole, and a second portion of the falling water flows counterclockwise around the outer perimeter to the drain hole.

20. The sink basin of claim 9 wherein a shape of the convex hump and the tilted outer perimeter near the bottom extent of the side walls cause water falling on the convex hump to flow outward toward the outer perimeter of the sink and around the perimeter toward the drain hole, and further wherein a first portion of the falling water flows clockwise around the perimeter, and a second portion of the falling water flows counterclockwise around the perimeter.

* * * * *